US007178585B1

(12) United States Patent
Mehendale et al.

(10) Patent No.: US 7,178,585 B1
(45) Date of Patent: Feb. 20, 2007

(54) HYBRID EVAPORATOR

(75) Inventors: Sunil S. Mehendale, Williamsville, NY (US); Scott B. Lipa, Snyder, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/197,422

(22) Filed: Aug. 4, 2005

(51) Int. Cl.
*F28D 1/06* (2006.01)

(52) U.S. Cl. ..... 165/153; 165/DIG. 465

(58) Field of Classification Search ..... 163/153, 163/176

See application file for complete search history.

(56) References Cited

U.S. PATENT DOCUMENTS 4,589,265 A 5/1986 Nozawa
4,621,685 A * 11/1986 Nozawa ..... 165/111
5,245,843 A 9/1993 Shimoya et al.
5,390,507 A 2/1995 Shimoya et al.
5,524,455 A 6/1996 Hasegawa et al.
5,553,664 A 9/1996 Nishishita et al.
5,701,760 A 12/1997 Torigoe et al.
6,216,773 B1 4/2001 Falta
6,321,834 B1 11/2001 Higashiyama
6,920,916 B2 * 7/2005 Higashiyama ..... 165/153
2003/0070797 A1 * 4/2003 Narahara et al. ..... 165/182

* cited by examiner

*Primary Examiner*—Allen J. Flanigan
(74) *Attorney, Agent, or Firm*—Patrick M. Griffin

(57) ABSTRACT

A laminate-type evaporator includes U-channel plates in combination with various configurations of dual cup and single cup plates, to control refrigerant pressure drop and achieve enhanced temperature spreads within the evaporator. The U-channel plates define one or more of the final refrigerant passes in the evaporator, and the dual cup and single cup plates define refrigerant passes upstream therefrom. Fins are disposed between adjacent plate pairs and extend to selected end edges of the U-channel plates to maximize the surface area available for heat exchange in the final refrigerant passes.

5 Claims, 8 Drawing Sheets

102
22
24
24
24
28
28
28
28
40
74
42
42
98
30
30
30
30
74
103
38
101
26
26
26
26
22
22
22

102
84
84
84
84
92
74
74
74
90
98
96
96
86
86
86
88
104
74
94
74
74
101
82
82
82
82
22
22
22

HYBRID EVAPORATOR

FIELD OF THE INVENTION

This invention relates to a heat exchanger, and more particularly, to an evaporator for the climate control system of a motor vehicle.

DESCRIPTION OF THE RELATED ART

Evaporators are well known in the art, and typically include a plurality of tubes having interiors through which refrigerant flows. Thermal energy, or heat, exchange occurs between ambient air flowing outside the tubes and the refrigerant flowing within. To enhance the amount of heat exchanged between the air and refrigerant, multiple fins are disposed between the adjacently positioned tubes. The fins are placed in contact with selected exterior surfaces of the tubes. This increases the surface area available for heat transfer from the air to the refrigerant circulating within the tubes, which in turn cools and dehumidifies the air as it flows across the exterior of the evaporator.

Heat transfer from the air to the refrigerant is further enhanced by routing the refrigerant to flow through the tubes so that it makes multiple passes through the interior passages of the tubes as air flows across the finned exterior. Unfortunately, because the refrigerant absorbs heat from the air, the cooling capacity of the refrigerant decreases with each additional pass the refrigerant makes. Thus, the air flowing across those tubes which form the initial passes of refrigerant is cooled to a greater extent and more efficiently than the air which flows across those tubes located further downstream and included in the latter passes. This inconsistency in heat exchange between the initial and latter refrigerant passes manifests itself as a non-uniform temperature distribution of the air leaving the evaporator and entering the passenger compartment (referred to as "temperature spreads").

The problem of non-uniform temperature of the discharge air is further exacerbated by the manner in which an evaporator core is designed. For example, in those evaporators fabricated from single cup, full plate tube plates only, high cooling capacity is achieved at the expense of large temperature spreads under certain operating conditions. For instance, non-uniform air temperature distribution occurs in such evaporators when a vehicle in which the evaporator is installed accelerates from rest. In this situation, the compressor of the climate control system quickly draws refrigerant out of the evaporator, causing high refrigerant superheats to occur within the last passes of the evaporator. Evaporators formed from U-channel tubes achieve temperature spreads which are more uniform than those achieved by single cup, full plates. However, the cooling capacity of such tubes is compromised by the increased pressure drop that occurs on the refrigerant side of the tubes, which is caused by the reduced cross-sectional area of the tubes available for refrigerant flow.

Although evaporators that utilize dual cup tubes to effectively create two cores through which the refrigerant flows in series first through one core and then the other achieve improved temperature spreads and greater cooling capacity than evaporators formed from U-channel tubes, increasing movement towards evaporator cores with smaller depths, necessitated by space constraints, has eroded these benefits. The smaller the core depth, the narrower the cross-sectional area of the tubes through which the refrigerant must flow, and the greater the refrigerant pressure drop, which has a negative impact on the cooling capacity of the evaporator core.

BRIEF SUMMARY OF THE INVENTION AND ADVANTAGES

The invention provides a laminate-type evaporator having a plurality of first plates stacked together in adjacent pairs. Each plate includes first and second tubular projections and a first recess. The plates are positioned in abutting engagement with one another such that the first tubular projections define a first tank, the second tubular projections define a second tank, and the first recesses define a plurality of initial passageways interconnecting the first and second tanks in fluid communication therewith.

The evaporator also includes a plurality of second plates stacked together in adjacent pairs. Each of the second plates extend between opposed end edges and include third and fourth tubular projections, as well as a pair of elongate recesses. The elongate recesses extend parallel to one another and are interconnected by a return recess disposed adjacent one of the end edges. Adjacent pairs of the second plates are in abutting engagement with one another such that the third tubular projections define a third tank positioned downstream from the second tank, the fourth tubular projections define a fourth tank, and the return and parallel recesses define a plurality of U-shaped passageways. The U-shaped passageways interconnect the third and fourth tanks, which permits a fluid refrigerant to enter the first tank and flow in an upstream to downstream direction through the initial passageways and the second tank, into the third tank, and through the U-shaped passageways prior to exiting the fourth tank.

Fins are disposed between the adjacent pairs of plates. Those fins disposed between adjacent pairs of the second plates are positioned in overlying relation to the return recesses and extend to the upper edges adjacent thereto for inducing a transfer of thermal energy between an airflow through the fins and the fluid flowing through the return recesses.

The subject invention overcomes the limitations of the art by providing an evaporator which utilizes U-channel plates in combination with various configurations of dual cup and single cup plates. The U-channel plates are utilized to define one or more of the final refrigerant passes in the evaporator, which aids in the distribution of the small quantity of liquid refrigerant that typically remains in those passes as the refrigerant vaporizes and its quality approaches unity. The dual and single cup plates are utilized in passes upstream from the U-channel plates to reduce the drop in pressure that would otherwise occur on the refrigerant side if U-channel plates were used throughout the evaporator. Extending the fins to the upper edges of the U-channel plates maximizes the surface area of the plates available for heat exchange in the final refrigerant passes.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
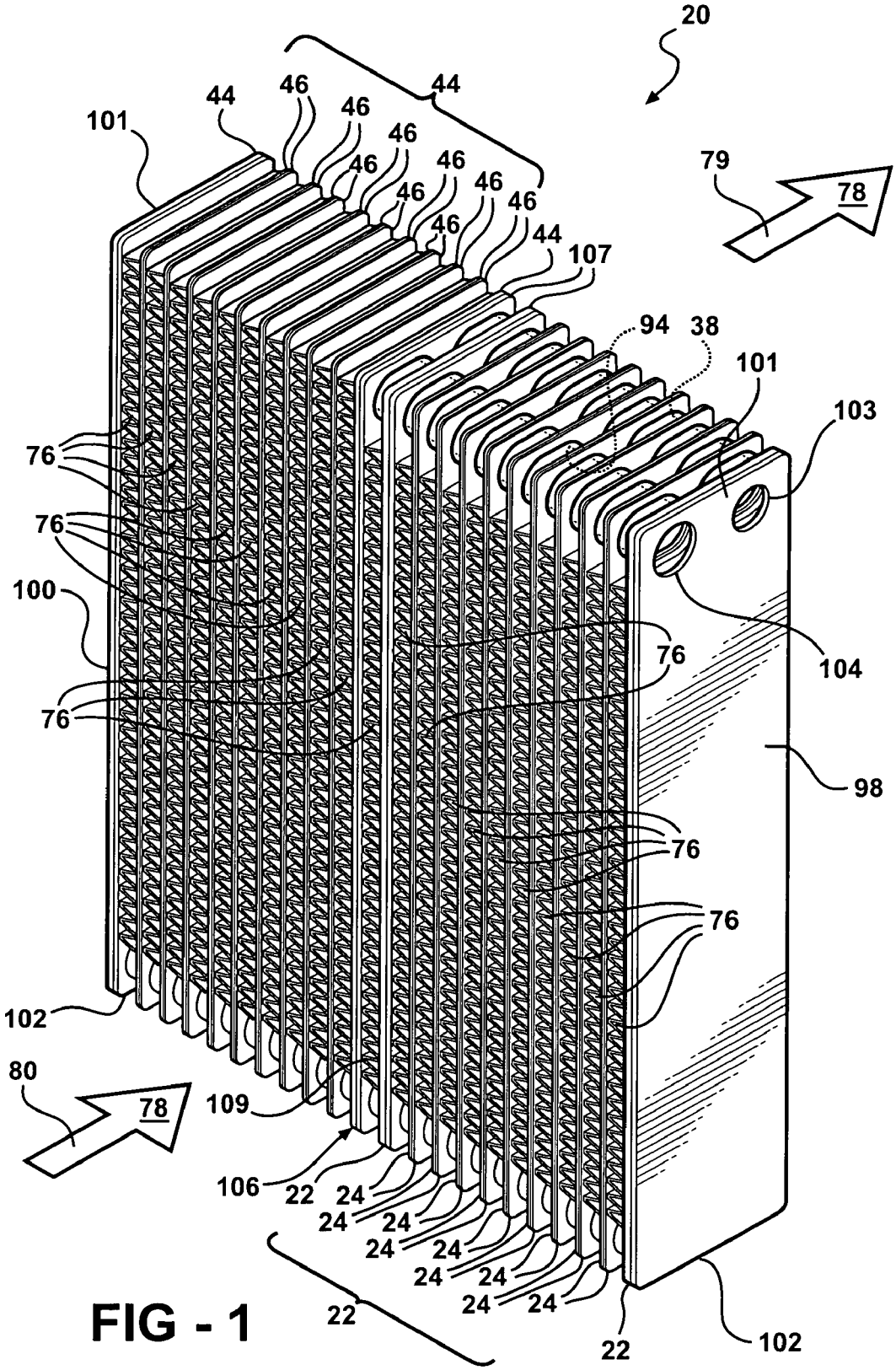
FIG. 1 is a perspective view of an evaporator according to an embodiment of the invention.
Figure 2:
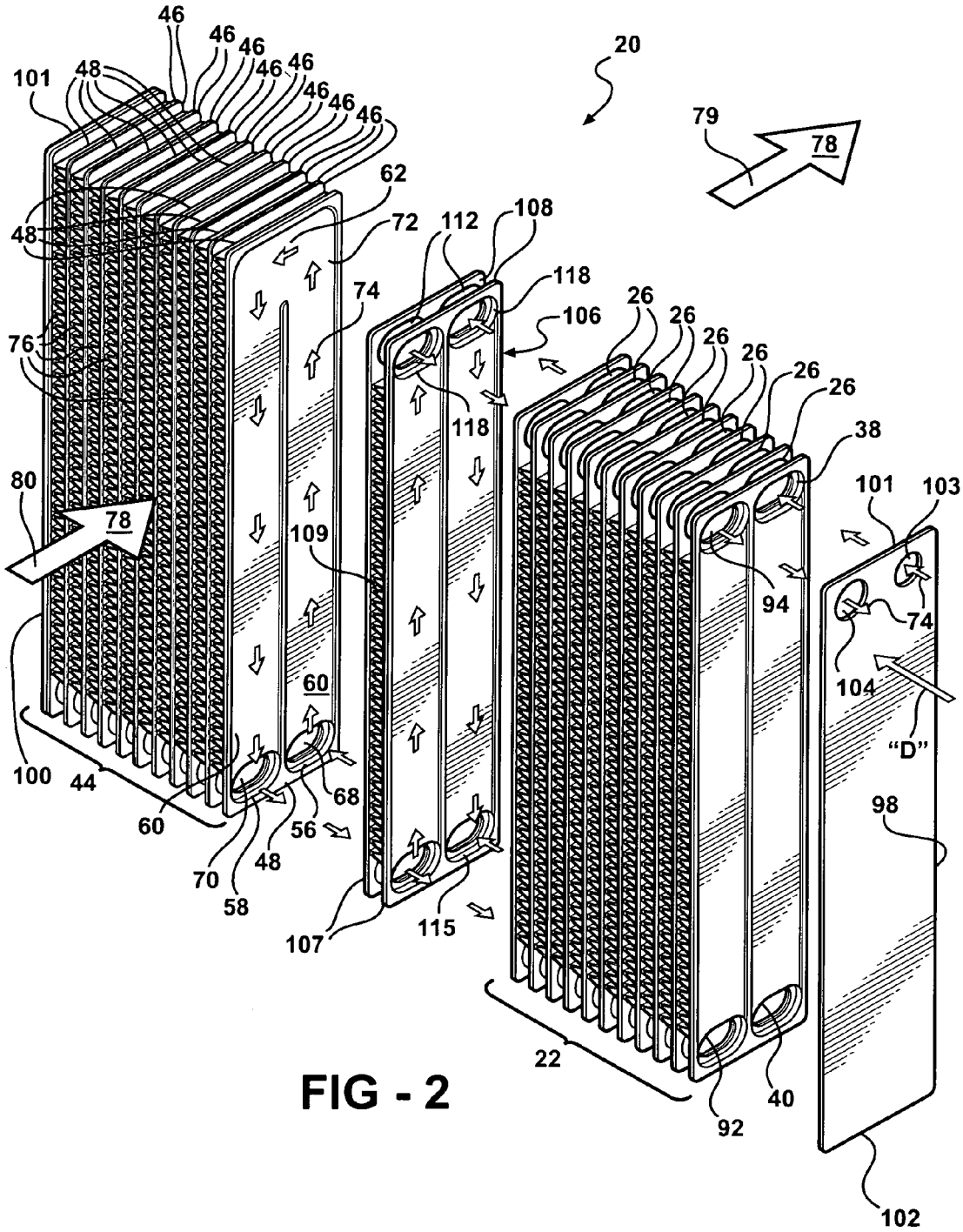
FIG. 2 is an exploded perspective view of the evaporator shown in FIG. 1.
Figure 3:
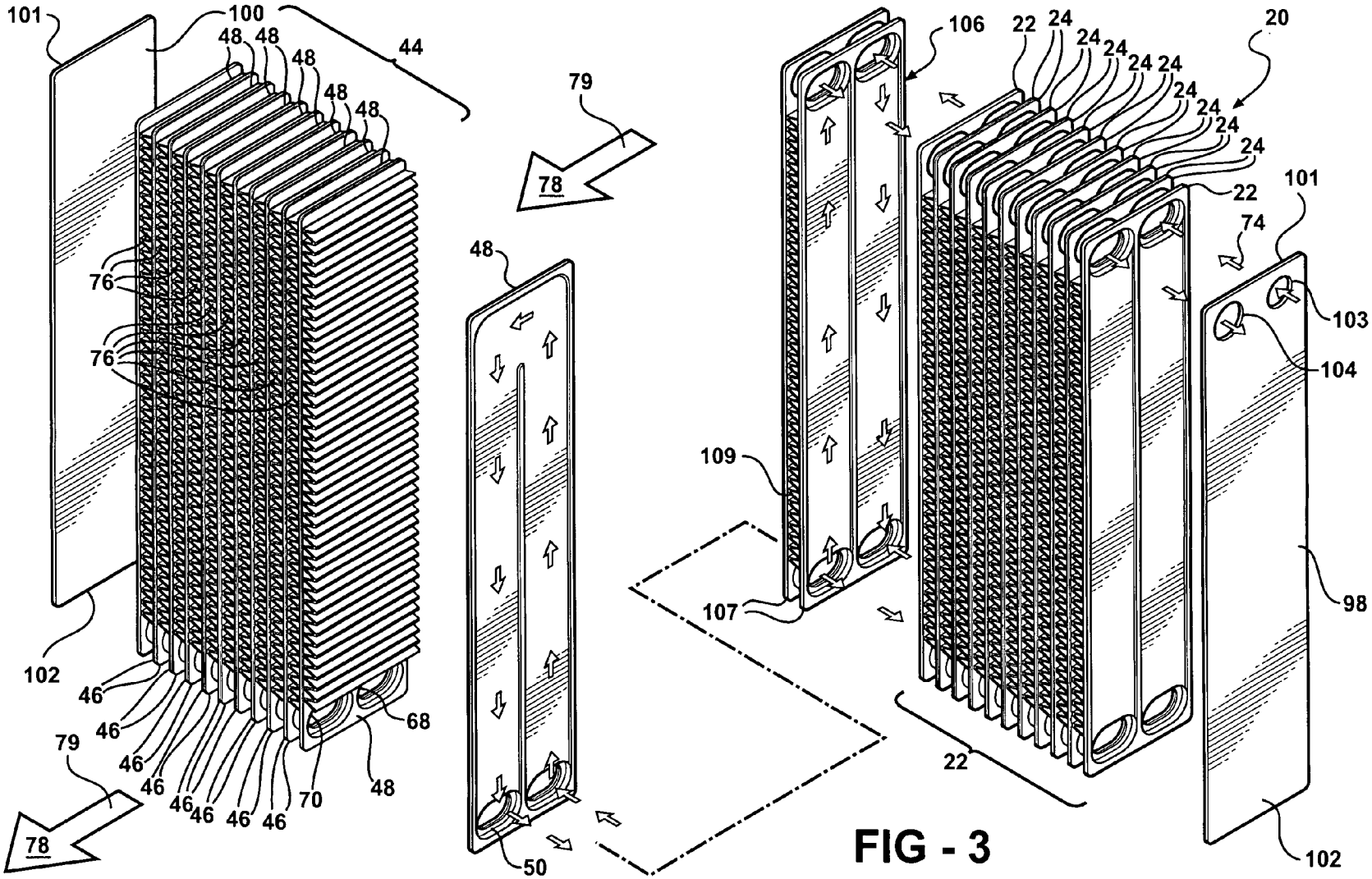
FIG. 3 is another exploded perspective view of the evaporator shown in FIG. 1.
Figure 4:
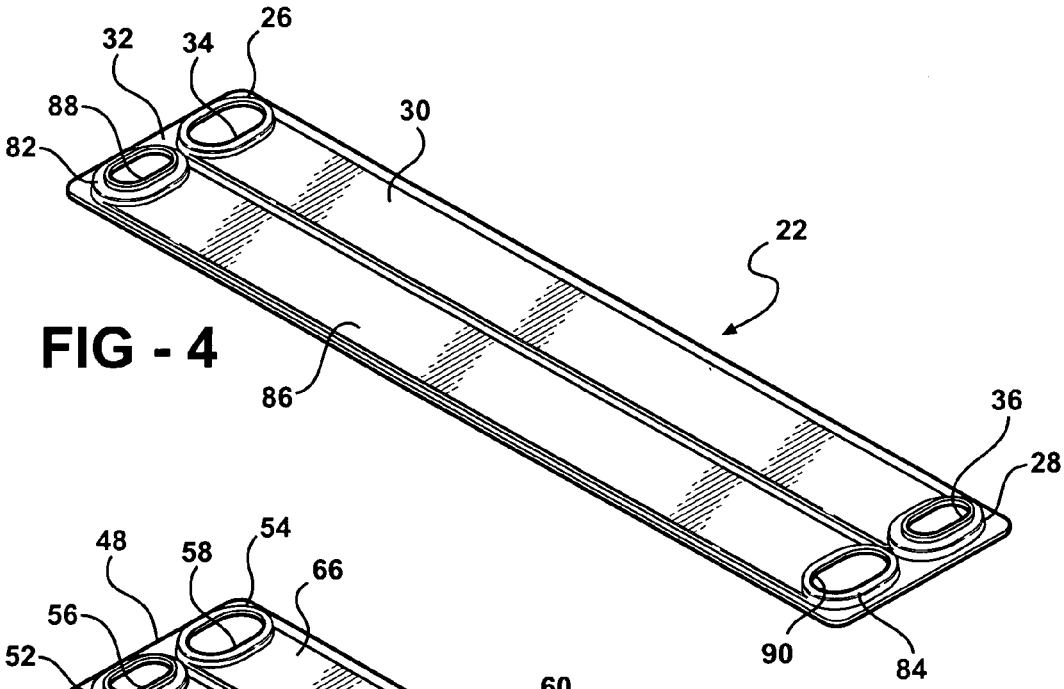
FIG. 4 is a perspective view of a dual cup plate utilized in the evaporator shown in FIG. 1.

Referring to the Figures, wherein like numerals indicate like or corresponding parts throughout the several views, a laminate-type evaporator is generally shown at 20 in FIGS. 1 through 3. The evaporator 20 includes a plurality of first tube plates 22 (dual cup tube plates) stacked together in adjacent pairs 24. As is best shown in FIG. 4, each first plate 22 includes first and second tubular projections 26, 28 and a first recess 30. The first plate 22 also has an exterior surface 32. The first recess 30 extends between the first and second tubular projections 26, 28. The first and second tubular projections 26, 28 define respective apertures 34, 36 through the plate 22. The projections 26, 28 also extend from the plate 22 in the same direction as the first recess 30.

Figure 5:
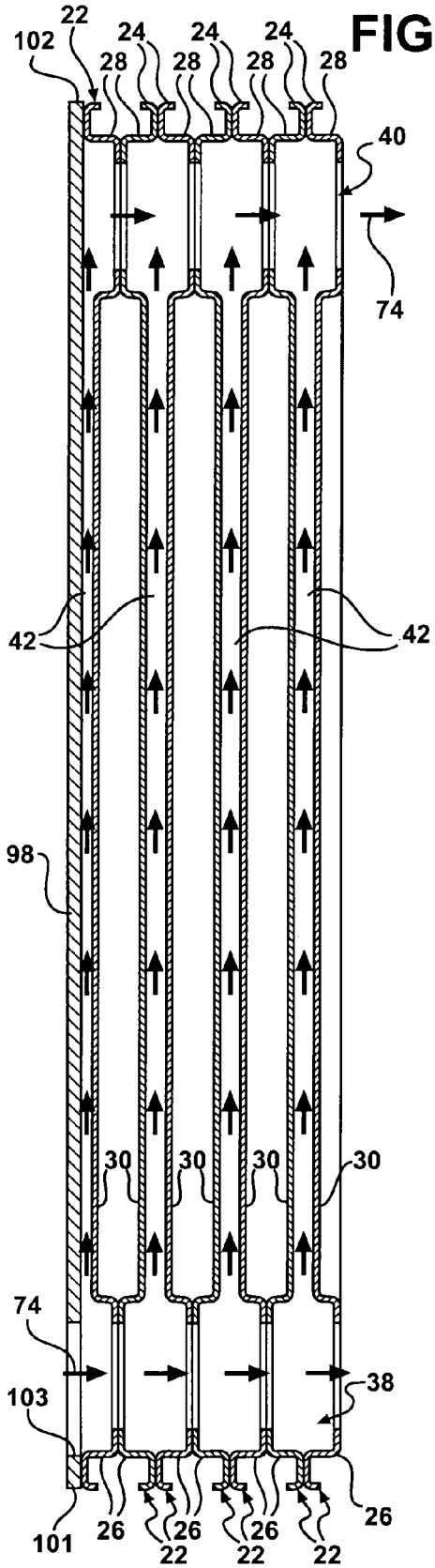
FIG. 5 is a partial cross-sectional view of the evaporator shown in FIG. 1.

Referring to FIGS. 1 and 2, the adjacent pairs 24 are positioned in abutting engagement with one another such that the first tubular projections 26 define a first tank 38 and the second tubular projections 28 define a second tank 40. As is shown in FIG. 5, the first recesses 30 define a plurality of initial passageways 42. The initial passageways 42 interconnect the first and second tanks 38, 40 and are in fluid communication therewith.

Figure 7:
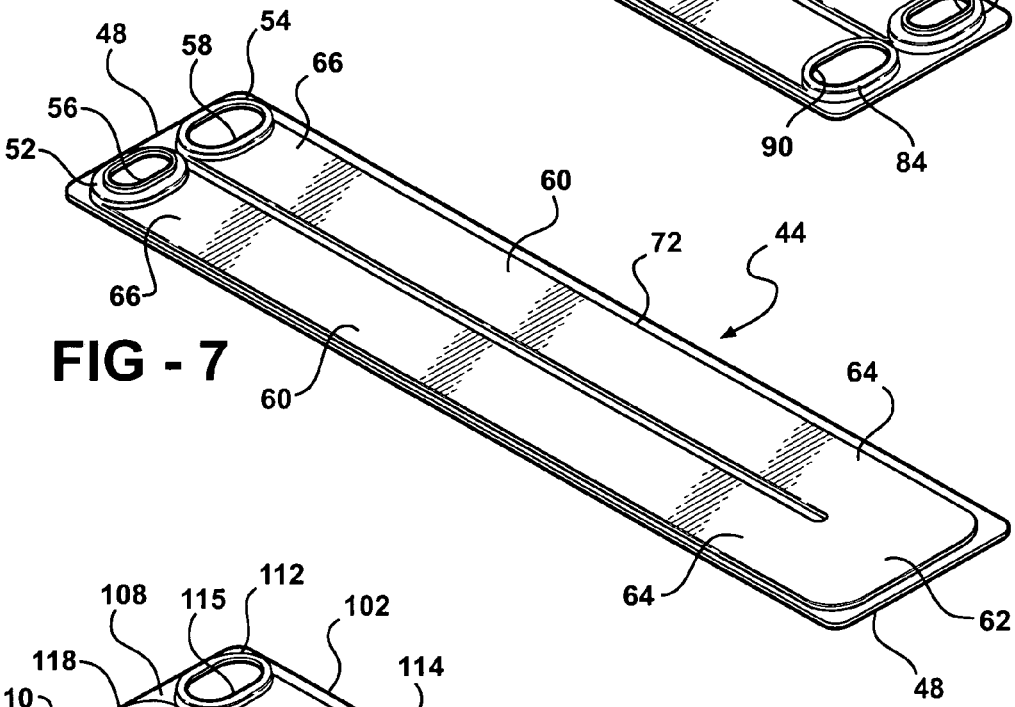
FIG. 7 is a perspective view of a U-channel plate utilized in the evaporator shown in FIG. 1.

Referring again to FIG. 1, the evaporator 20 also includes a plurality of second tube plates 44 (U-channel tube plates). Like the first plates 22, the second plates 44 are stacked together in adjacent pairs 46. However, as is shown in FIG. 7, each of the second plates 44 extend between opposed end edges 48 and include third and fourth tubular projections 52, 54. The third and fourth projections 52, 54 are positioned adjacent the lower edge 48 and define respective apertures 56, 58. A pair of elongate recesses 60 extends parallel to one another and are interconnected by a return recess 62 positioned adjacent one of the end edges 48. Each elongate recess 60 extends from an upper end 64 to a lower end 66, with the return recess 62 interconnecting the upper ends 64. Each of the lower ends 66 is in fluid communication with a selected one of the apertures 56, 58.

Referring again to FIG. 2, the adjacent pairs 46 of second plates 44 are positioned in abutting engagement with one another with the third tubular projections 52 defining a third tank 68. The third tank 68 is positioned downstream from the second tank 40 and is in fluid communication therewith. The fourth tubular projections 54 define a fourth tank 70, and the elongate and return recesses 60, 62 define a plurality of U-shaped passageways 72. The passageways 72 interconnect the third and fourth tanks 68, 70, which in turn permits a fluid, or fluid stream, 74 to enter the first tank 38, and then flow in an upstream to downstream direction "D" through the initial passageways 42 and second tank 40, into the third tank 68, and through the U-shaped passageways 72 prior to exiting the fourth tank 70. The flow from tank 70, as more fully described herein after, flows t the fifth tank 92 via the separator plates 107.

Although not shown for clarity the various plates typically include bumps, dimples, fins, or the like, to project into the flow in the u-shaped passageways to control flow and/or enhance heat transfer. Any combination of such flow control devices may be employed in the subject invention.

Referring again to FIG. 1, the evaporator 20 also includes a plurality of fins 76, which are disposed between adjacent pairs 24, 46 of the plates 22, 44. In particular, each fin 76 is interposed between a selected pair of the first plate pairs 24 or a selected pair of the second plate pairs 46. As is best shown in FIG. 3, those fins 76 interposed between adjacent pairs 46 of the second plates 44 are positioned in overlying relation to the return recesses 62 and extend to the upper edges 48 adjacent thereto, which in turn induces a transfer of thermal energy between an airflow 78 flowing through the fins 76 and the fluid stream 74 flowing through the return recesses 62. The airflow 78 travels through the fins 76 from an downstream airside 80 to a upstream airside 79 of the evaporator 20.

Although those fins 76 that are interposed between the adjacent pairs 24 of first plates 22 are capable of inducing a transfer of thermal energy between the airflow 78 passing through the fins 76 and the fluid stream 74 as it flows through the initial passageways 30, the surface area on the plates 22 that is actually available for heat exchange is reduced by the presence of the first and second tanks 38, 40 at the respective ends of the plates 22. As is shown in FIG. 1, the surface area of the fins 76 and passageways 30 is limited to that which is located between the first and second tanks 38, 40. In contrast, the third and fourth tanks 68, 70 are disposed adjacent those end edges 48 located adjacent the lower ends 66 of the elongate recesses 60 on the second plates 44, which allows the return recesses 62 within the plates 44 and the fins 76 disposed against the exterior thereof to extend to the end edges 48 opposite the tanks 68, 70 This increases the total air side and refrigerant side surface area available for heat transfer in a portion of the heat exchanger where the fluid stream 74 has higher vapor quality than at the inlet of the evaporator and this helps to maximize heat exchange between air and refrigerant.

Figure 6:
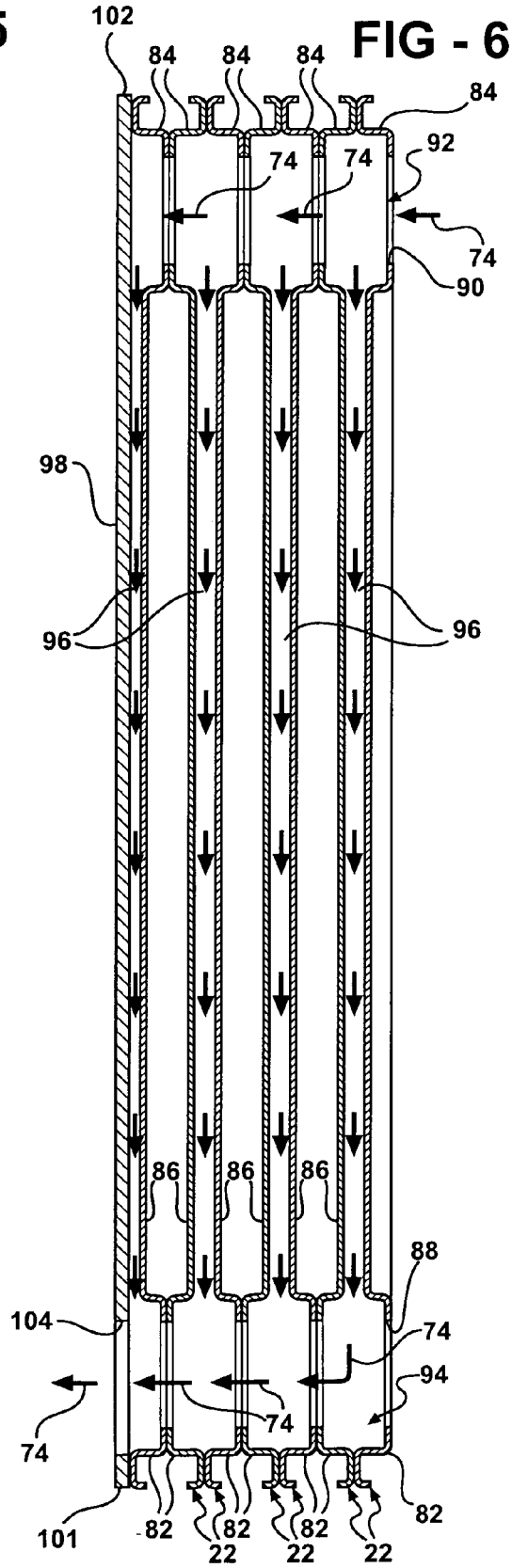
FIG. 6 is another partial cross-sectional view of the evaporator shown in FIG. 1.

Referring again to FIG. 4, each first plate 22 also includes fifth and sixth tubular projections 82, 84. A second recess 86 extends parallel to the first recess 30 between the fifth and sixth tubular projections 82, 84. The fifth and sixth tubular projections 82, 84 define respective apertures 88, 90 through the plate 22, and the second recess 86 interconnects and is in fluid communication with the apertures 88, 90. As is shown in FIG. 2, the fifth tubular projections 82 define a fifth tank 92 positioned downstream from the fourth tank 70 and the sixth tubular projections 84 define a sixth tank 94. The second recesses 86 define a plurality of final passageways 96 that interconnect the fifth and sixth tanks 92, 94 and are in fluid communication therewith. Furthermore, the fifth tank 92 is in fluid communication with the fourth tank 70, which allows the fluid stream 74 to flow from the fourth tank 70 into the fifth tank 92. As is best shown in FIG. 6, the fluid stream 74 then flows through the final passageways 96 and into the sixth tank 94.

Referring again to FIG. 1, the evaporator 20 also includes first and second end plates 98, 100. Each end plate 98, 100 has upper and lower edges 101, 102. The first end plate 98 is disposed against the first plates 22 upstream therefrom and includes an inlet 103 and an outlet 104 that are axially aligned with the first tank 38 and sixth tank 94, respectively. As is shown in FIG. 3, the fluid stream 74 enters the evaporator 20 through the inlet 103 and exits through the outlet 104. The second end plate 100 is disposed against the second plates 44 downstream from the third tank 68, and directs the fluid stream 74 to flow from the third tank 68, through the U-shaped passageways 72 and into the fourth tank 70.

The evaporator 20 also has a first flow separator 106. The separator 106 is disposed between the first and second plates 22, 44 for directing the fluid stream 74 to flow from the first plates 22 to the second plates 44. As is best shown in FIG. 2, the first flow separator 106 is fabricated from a pair of first separator plates 107. Each separator plate 107 has an exterior surface 108 disposed in a back-to-back relationship relative to the exterior surface 108 of the other separator plate 107. A fin 109 is disposed between the exterior surfaces 108, and is fabricated from the same materials as the fins 76.

Figure 8:
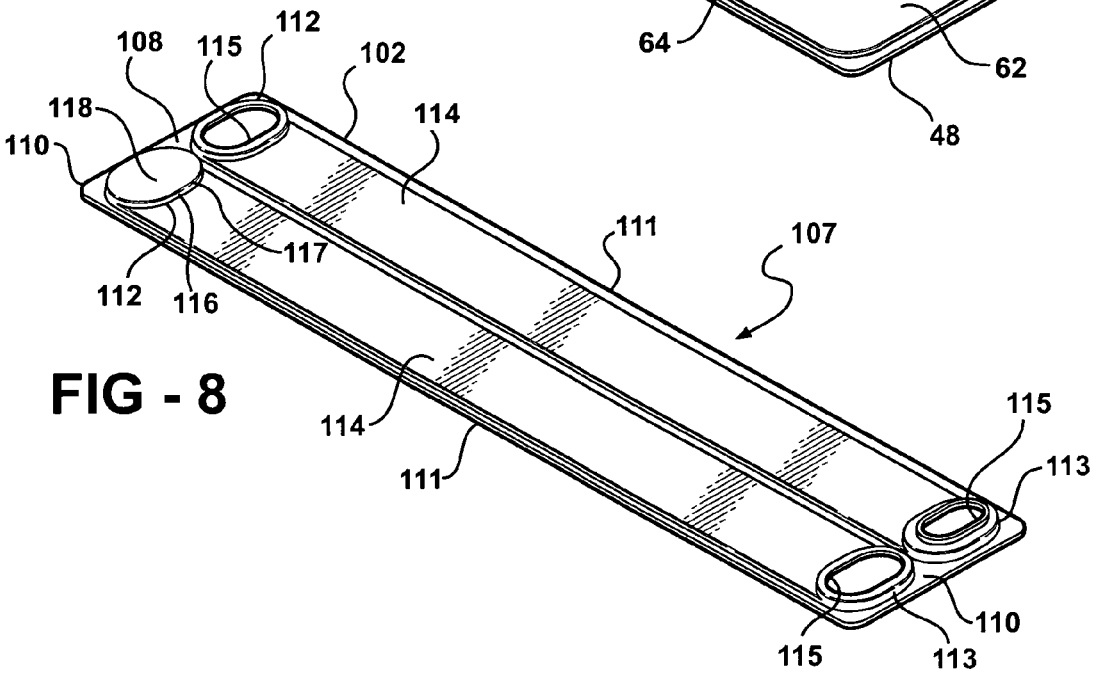
FIG. 8 is a perspective view of one of the separator plates utilized in the first flow separator shown in FIGS. 2 and 3.

Referring now to FIG. 8, one of the first separator plates 107 is shown. The separator plate 107 has opposed end edges 110 and elongate side edges 111. A first pair of projections 112 extends from the first separator plate 107 adjacent one of the end edges 110. A second pair of projections 113 extends from the plate 107 adjacent the other end edge 110. Recessed portions 114 extend parallel to one another between the first and second pairs of projections 112 and 113. The portions 114 are recessed relative to the end edges 110 and side edges 111, and protrude from the exterior surface 108 in the same direction as the first and second pairs of projections 112, 113.

Each of the second pair of projections 113 includes an aperture 115; however, only one of the first pair of projections 112 has an aperture 115. The other projection 112 has a cylindrical sidewall 116 that extends to an upper edge 117. A planar face 118 likewise extends to the upper edge 117.

Referring again to FIG. 2, when the exterior surfaces 108 are disposed back-to-back relative to one another, the first pairs of projections 112 engage one another so that the planar face 118 on each separator plate 107 covers the aperture 115 defined by the projection 112 extending from the other plate 107. This prevents the fluid stream 74 from flowing downstream past the first flow separator 106 as the stream 74 exits the first tank 38, and instead diverts the fluid stream 74 through the initial passageways 42 into the second tank 40. The fluid stream 74 then exits through the aperture 115 on the downstream airside 79 of the evaporator 20 and flows into the third tank 68 and through the second plates 44. Upon returning from the fourth tank 70 through the aperture 115 on the upstream airside 80, the fluid stream 74 flows through the fifth tank 92 and the final passageways 96, encounters the end plate 98, and is directed to flow into the sixth tank 94 prior to exiting the evaporator 20 through the outlet 104. The planar face 118 positioned on the flow separator 106 on the upstream airside 80 prevents the fluid stream 74 in tank 94 from flowing beyond the flow separator 106 and back into the flow passages 72 of the plates 44.

Figure 9:
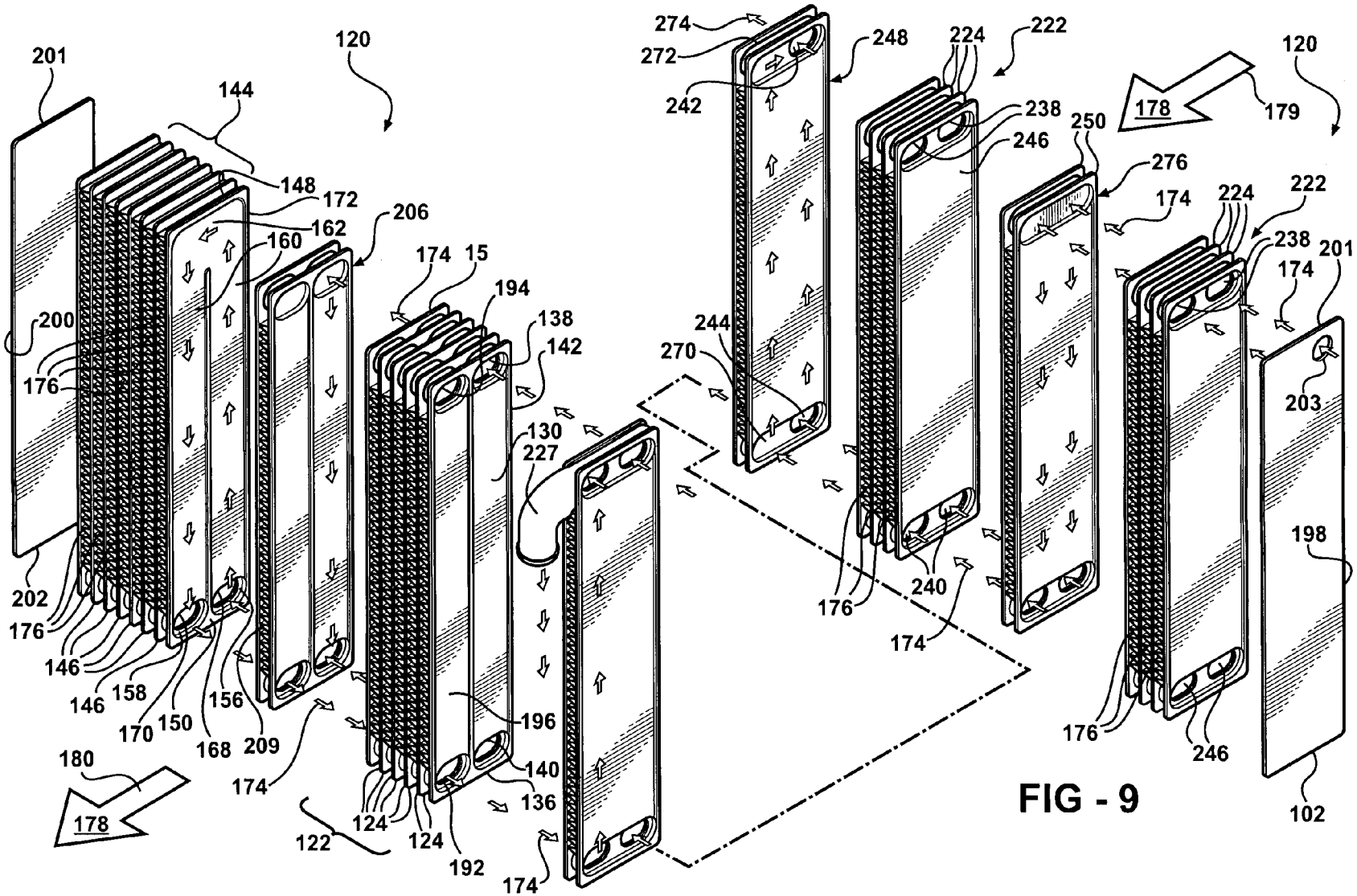
FIG. 9 is an exploded perspective view of an evaporator according to an alternative embodiment of the invention.
Figure 10:
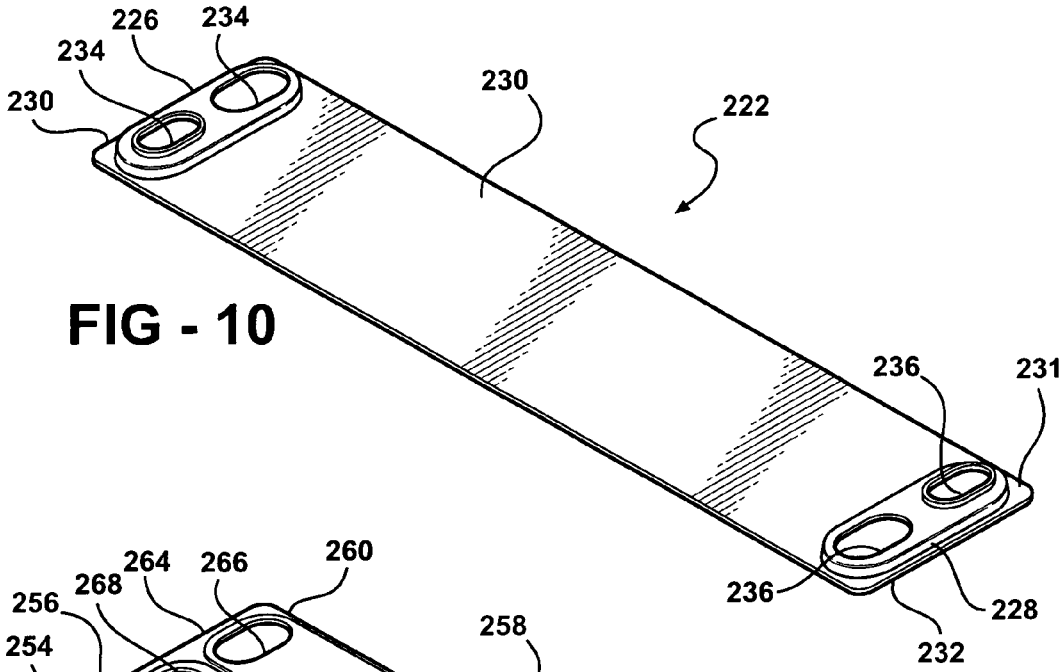
FIG. 10 is a perspective view of a single cup plate utilized in the evaporator shown in FIG. 9.

Referring now to FIG. 9, a laminate-type evaporator according to an alternative embodiment of the invention is generally shown at 120. The evaporator 120 includes first plates 122, second plates 144, fins 176, 209 and a first flow separator 206 which are fabricated from the same materials, include the same components and are interconnected in the same manner as the first plates 22, second plates 44, fins 76, 109 and first flow separator 106, respectively, of the evaporator 20. However, unlike the evaporator 20, the evaporator 120 also includes a plurality of third plates 222 stacked together in adjacent pairs 224. In addition, instead of having an outlet formed in the first end plate 198, a fluid outlet 227, is positioned downstream from the sixth tank 194 and is in fluid communication therewith Referring now to FIG. 10, one of the third plates 222 is shown. The third plate 222 includes upper and lower tubular projections 226, 228 and an elongate recessed portion 230. The first tubular projections 226 define a pair of upper apertures 234, and the second tubular projections 228 define a pair of lower apertures 236. The elongate recessed portion 230 extends between the upper and lower tubular projections 226, 228. As is shown in FIG. 10, the recessed portion 230 and upper and lower tubular projections 226, 228 extend in the same direction from an exterior surface 231 of the third plate 222.

Referring again to FIG. 9, adjacent pairs 224 of the third plates 222 are in abutting engagement with one another. The first tubular projections 226 define at least one, or as shown, two upper tanks 238 and the second tubular projections 228 define at least one, or as shown, two lower tanks 240. The upper and lower tanks 238, 240 are positioned upstream from the first tank 138.

The elongate recessed portions 230 define a plurality of fluid passageways 246 that interconnect the upper and lower tanks 238, 240. The passageways 246 are in fluid communication with the upper and lower tanks 238, 240, which allows the fluid stream 174 to flow through the fluid passageways 246 between the upper and lower tanks 238, 240 prior to entering the first tank 138 and flowing through the evaporator 120 along a fluid pathway identical to that which is described above regarding the fluid stream 74 which flows through the evaporator 20.

Like the first flow separator 106 of the evaporator 20, the first flow separator 206 of the evaporator 120 is disposed intermediate the first and second plates 122, 144 for directing the fluid stream 174 to flow from the first plates 122 to the second plates 144. A second flow separator 248 is interposed between the first and third plates 122, 222 for directing the fluid stream 174 to flow from the upper tanks 242 in the third plates 270 into the first tank 138.

Unlike the first flow separator 206, which is formed from a pair of first separator plates 207 identical to the first separator plates 107 described above with reference to FIG. 8, the second flow separator 248 is formed from a first separator plate 207 and a second separator plate 250.

Figure 11:
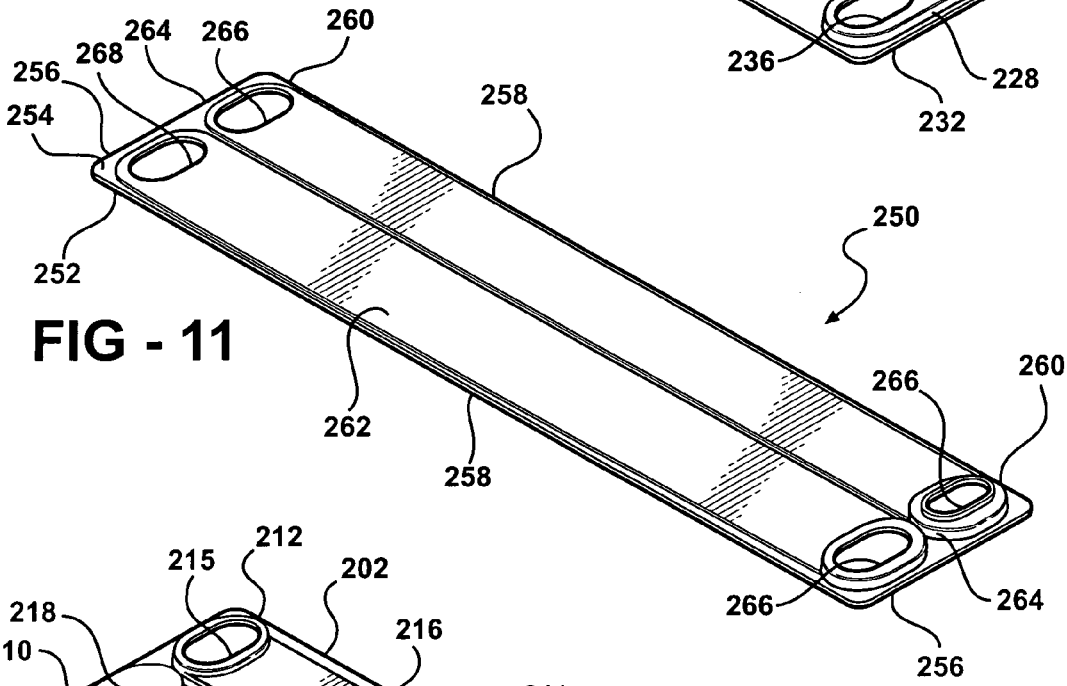
FIG. 11 is a perspective view of a second flow separator plate utilized in the second flow separator of the evaporator shown in FIG. 9.

Referring now to FIG. 11, the second separator plate 250 has interior and exterior surfaces 252, 254 and opposed end edges 256 interconnected by elongate side edges 258. Projections 260 extend from the exterior surface 254. Each projection 260 is positioned adjacent a selected one of the end edges 256. An elongate recessed portion 262 extends between the projections 260. The recessed portion 262 is recessed relative to the interior surface 252 and extends from the exterior surface 254 in the same direction as the projections 260.

Like the upper tubular projections 226 on the third plates 222, one of the projections 260 has an upper surface 264 defining a pair of apertures 266. In contrast, the other projection 260 has an upper surface 264 defining a single aperture 266 located adjacent a planar area 268.

Figure 12:
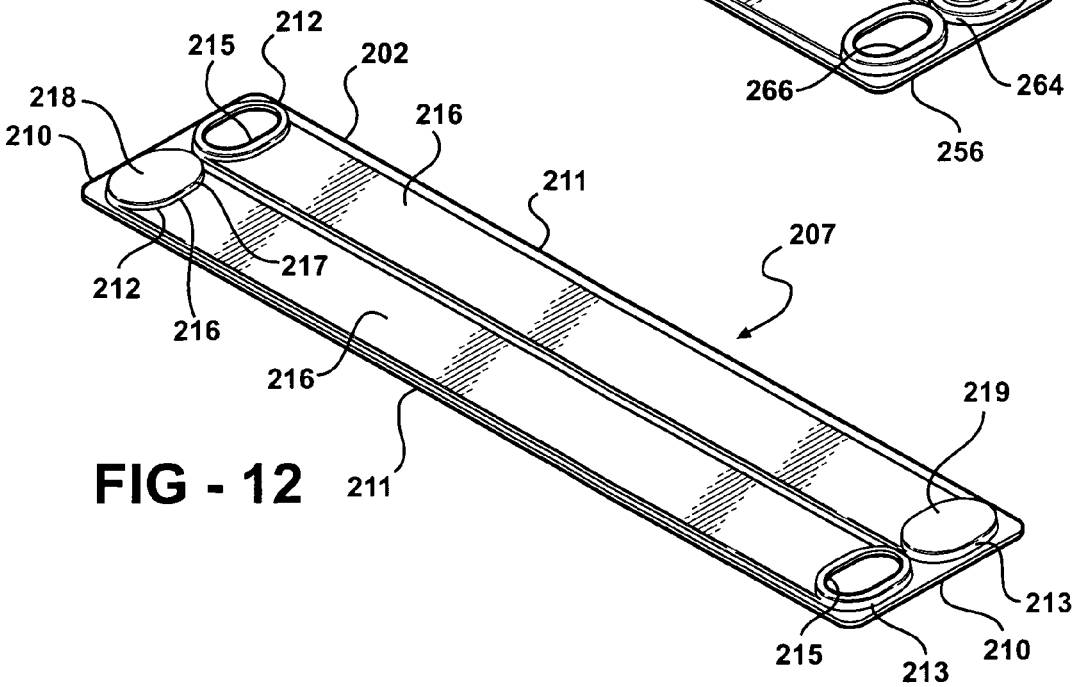
FIG. 12 is a perspective view of the first flow separator plate utilized in the second flow separator of the evaporator shown in FIG. 9.

Referring now to FIG. 12, the first separator plate 207 is shown. With the exception of one of the second pair of projections 213 including a second planar face 219 instead of an aperture 215, the first separator plate 207 is identical to the first separator plate 107 described above with reference to FIG. 8.

Referring again to FIG. 9, the second flow separator 248 includes a lower diverting portion 270, which is disposed in the lower tanks 244 for directing the fluid stream 274 to flow therefrom into the upper tanks 242, and an upper diverting portion 272, which is disposed in the upper tank 242 intermediate the first and third plates 122, 222 for directing the fluid stream 174 to flow from the third plates 222 into the first tank 138. In addition, a final diverting portion 274 is disposed in the upper tank 242 adjacent the sixth tank 194 for directing the fluid stream 174 to flow from the sixth tank 194 into the fluid outlet 227.

The lower, upper and final diverting portions 270, 272, 274 of the second flow separator 206 are formed by disposing the first separator plate 207 against the second separator plate 250 so that the exterior surfaces 208, 254 are in a back-to-back relationship relative to one another. The planar face 219 on the first separator plate 207 covers the single aperture 266 on the second separator plate 250 and the planar area 268 is disposed over the aperture 215 located adjacent the planar face 219 to define the lower diverting portion 270. The upper and final diverting portions 272, 274 are formed by positioning the planar face 218 of the first separator plate 207 over one of the apertures 266 located adjacent the end edge 256 on the second separator plate 250.

Although not required, the evaporator 120 also includes an upstream flow separator 276. As is shown in FIG. 9, the upstream flow separator 276 is disposed between two of the adjacent pairs 224 of third plates 222 for directing the fluid stream 174 to flow from the upper tanks 242 to the lower tanks 244. The separator 276 is formed using a pair of the second separator plates 250. The second separator plates 250 are disposed with the exterior surfaces 254 positioned in a back-to-back relationship with one another so that the planar area 268 on each plate 250 covers the single aperture 266 on the other plate 250. The upstream flow separator 276 is then positioned between the selected adjacent pairs 224 of third plates 222 and oriented so that the planar areas 268 are disposed within the upper tanks 242, which in turn diverts the fluid stream 174 into the lower tanks 244.

Figure 13:
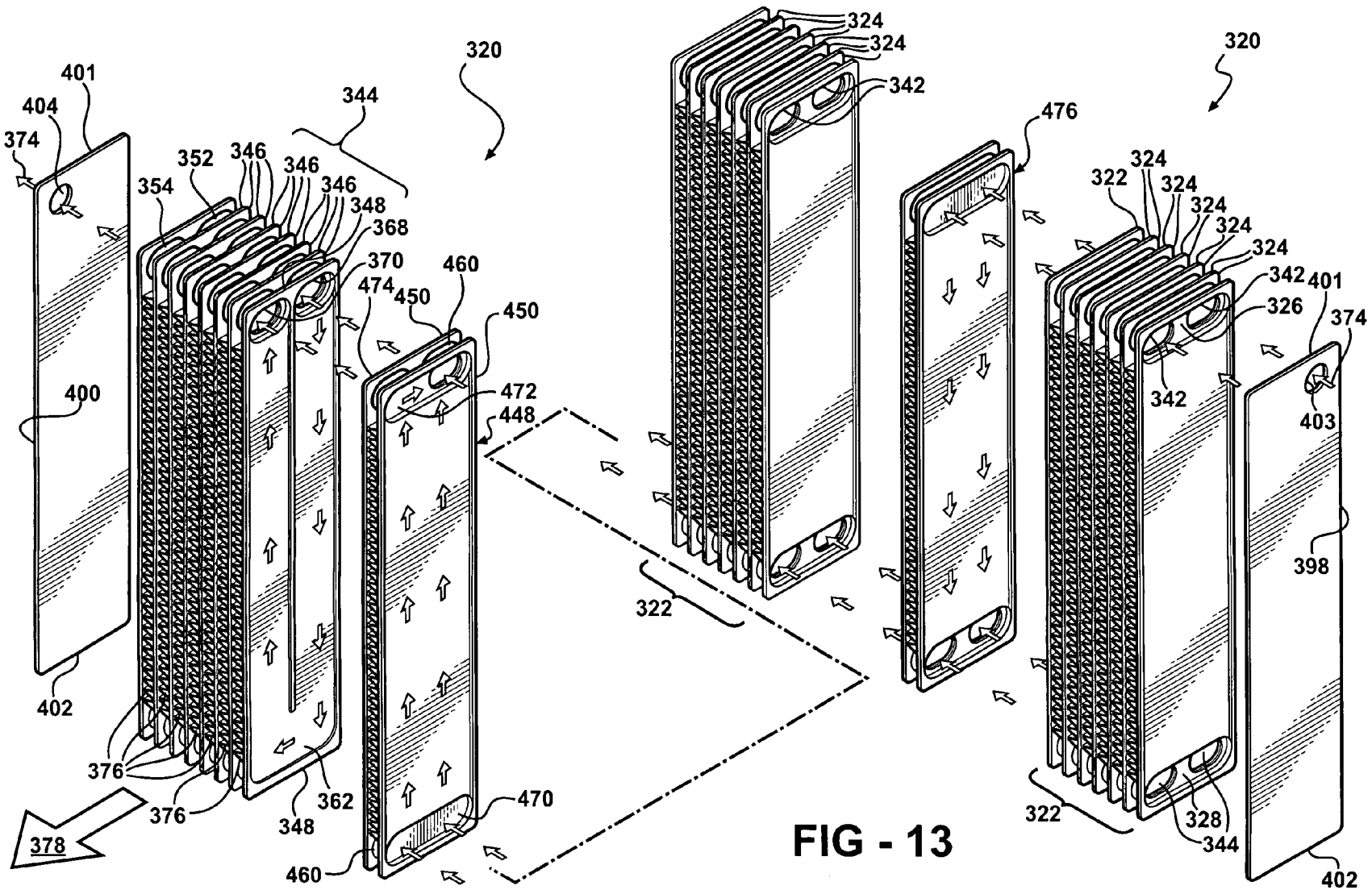
FIG. 13 is an exploded perspective view of an evaporator according to another alternative embodiment of the invention.

Referring now to FIG. 13, an evaporator according to another alternative embodiment of the invention is generally shown at 320. The evaporator 320 includes a plurality of first plates 322 stacked together in adjacent pairs 324. The first plates 322 are fabricated in the same manner and include the same components as the third plates 222 of the evaporator 120 and described above with reference to FIG. 10. However, in contrast to the third plates 222, which are used in combination with the first and second plates 122; 144 in the evaporator 120, the first plates 322 are combined solely with the second plates 344 in the evaporator 320.

The evaporator 320 also includes a plurality of second plates 344 which are likewise stacked together in adjacent pairs 346. Although the second plates 344 include the same components as the second plates 44, 144, the second plates 344 are oriented within the evaporator 320 in a different manner than that of the second plates 44, 144. As is shown in FIG. 13, the evaporator 320 features a first end plate 398 identical in structure and function to the first end plate 198 utilized in the evaporator 120. However, unlike the second end plate 200 of the evaporator 120, the second end plate 400 includes an outlet 404 and is disposed against the second plates 344 downstream from the upstream tank 368, with the outlet 404 aligned with the downstream tank 370 to permit the vaporized fluid stream 374 to exit therethrough.

The second plates 344 are positioned so that the third 368 and fourth 370 tanks are disposed adjacent the upper edge 401 of the end plate 400 and the return recesses 362 are disposed adjacent the lower edge 402. This differs from the second plates 44, 144, which are oriented within the evaporators 20, 120 so that the third and fourth tanks 68, 70, 168, 170 are adjacent the lower edge 102, 202, and the return recesses 62, 162 are adjacent the upper edge 101, 201.

As is shown in FIG. 13, the projections 352, 354 define respective upstream and downstream tanks 368, 370 which are in fluid communication with the lower ends 364 of the elongate recesses 360. The return recesses 362 interconnect the upper ends 366, which in turn defines a plurality of U-shaped passageways 372. The passageways 372 interconnect the upstream and downstream tanks 368, 370, which in turn permits the fluid stream 374 to enter the upstream tank 368, and flow through the U-shaped passageways 372 prior to exiting the downstream tank 370. Orienting the second plates 344 in this manner permits the U-shaped passageways 372 to be utilized in the final refrigerant pass without requiring that the fluid stream 374 be directed back toward the first plates 322 prior to exiting the evaporator 320.

The evaporator 320 also includes a plurality of fins 376 disposed between the adjacent plate pairs 324, 346. Those fins 376 which are disposed between the adjacent pairs 346 of second plates 344 extend to the lower edges 348. The increased surface area of the fins 376 provides the same advantages as that of the fins 76 described above with reference to FIG. 3. Specifically, the increased surface area permits a thermal energy exchange between the airflow 378 flowing through the fins 376 and the fluid stream 374 as it flows through the return recesses 362. This maximizes heat transfer from the airflow 378 to the fluid stream 374 and improves the discharge air temperature uniformity of the evaporator 320.

A downstream flow separator 448 is interposed between the first and second plates 322, 344 for directing the fluid stream 374 to flow from the upper tanks 342 into the upstream tank 368. The downstream flow separator 448 is formed from a pair of separator plates 450 (line one shown in FIG. 11 but without the apertures 266 i.e., blocked) having projections 460 disposed against one another to define lower, upper and final diverting portions 470, 472, 474 that function in a manner identical to that of the slow separators described above. In essence, the respective flow paths defined by the second flow separator 248 and downstream flow separator 448 are identical. An upstream flow separator 476 is disposed between two of the adjacent pairs 324 of first plates 322. The upstream flow separator 476 is fabricated using the same components and functions in the same manner as the upstream flow separator 276 utilized in the evaporator 120 and described above with reference to FIGS. 9 and 11.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A laminate-type evaporator comprising:

a plurality of first plates stacked together in adjacent pairs with each of said plates including first and second tubular projections and a first recess, said adjacent pairs positioned in abutting engagement with one another with said first tubular projections defining a first tank, said second tubular projections defining a second tank, and said first recesses defining a plurality of passageways interconnecting said first and second tanks in fluid communication therewith;

a plurality of second plates stacked together in adjacent pairs with each of said second plates extending between opposed end edges and including third and fourth tubular projections, a pair of elongate recesses extending parallel to one another, and a return recess interconnecting said elongate recesses adjacent one of said end edges, said adjacent pairs of said second plates positioned in abutting engagement with one another with said third tubular projections defining a third tank positioned downstream from said second tank in fluid communication therewith, said fourth tubular projections defining a fourth tank and said elongate and return recesses defining a plurality of U-shaped passageways interconnecting said third and fourth tanks, for permitting a fluid to enter said first tank and flow in an upstream to downstream direction through said initial passageways and said second tank into said third tank and through said U-shaped passageways prior to exiting said fourth tank; and a plurality of fins disposed between said adjacent pairs of said plates with each of said fins interposed between said adjacent pairs of said second plates overlying said return recesses and extending to said end edges adjacent thereto for inducing a transfer of thermal energy between an airflow through said fins and the fluid flowing through said return recesses;

wherein each of said first plates include fifth and sixth tubular projections and a second recess extending parallel to said first recess wherein said fifth tubular projections define a fifth tank positioned downstream from said fourth tank in fluid communication therewith and said sixth tubular projections define a sixth tank with said second recesses defining a plurality of final passageways interconnecting said fifth and sixth tanks, in fluid communication therewith;

a plurality of third plates stacked together in adjacent pairs with each of said third plates having first tubular projections of said third plate and second tubular projections of said third plate, and an elongate recessed portion wherein said third plates are in abutting engagement with one another with said first tubular projections of said third plate defining at least one upper tank and said second tubular projections of said third plate defining at least one lower tank positioned upstream from said first tank in fluid communication therewith wherein said elongate recessed portions define a plurality of fluid passageways interconnecting said upper and lower tanks in fluid communication therewith;

a first flow separator, disposed between said first and second plates, for directing the fluid to flow from said first plates to said second plates; and a second flow separator interposed between said first and third plates, for directing the fluid to flow from said third plates to said first plates;

wherein said second flow separator includes a lower diverting portion disposed within said lower tank for directing the fluid to flow therefrom into said upper tank.

2. An evaporator as recited in claim 1 and including a fluid outlet downstream from said sixth tank in fluid communication therewith.

3. An evaporator as recited in claim 2 wherein said second flow separator includes an upper diverting portion disposed in said upper tank intermediate said first and third plates, for directing the fluid to flow from said third plates to said first tank.

4. An evaporator as recited in claim 3 wherein said second flow separator includes a final diverting portion disposed in said upper tank adjacent said sixth tank for directing the fluid to flow from said sixth tank into said fluid outlet.

5. A laminate-type evaporator comprising:

a plurality of first plates stacked together in adjacent pairs with each of said plates including first and second tubular projections and a first recess, said adjacent pairs positioned in abutting engagement with one another with said first tubular projections defining a first tank, said second tubular projections defining a second tank, and said first recesses defining a plurality of passageways interconnecting said first and second tanks in fluid communication therewith;

a plurality of second plates stacked together in adjacent pairs with each of said second plates extending between opposed end edges and including third and fourth tubular projections, a pair of elongate recesses extending parallel to one another, and a return recess interconnecting said elongate recesses adjacent one of said end edges, said adjacent pairs of said second plates positioned in abutting engagement with one another with said third tubular projections defining a third tank positioned downstream from said second tank in fluid communication therewith, said fourth tubular projections defining a fourth tank and said elongate and return recesses defining a plurality of U-shaped passageways interconnecting said third and fourth tanks, for permitting a fluid to enter said first tank and flow in an upstream to downstream direction through said initial passageways and said second tank into said third tank and through said U-shaped passageways prior to exiting said fourth tank; and a plurality of fins disposed between said adjacent pairs of said plates with each of said fins interposed between said adjacent pairs of said second plates overlying said return recesses and extending to said end edges adjacent thereto for inducing a transfer of thermal energy between an airflow through said fins and the fluid flowing through said return recesses;

wherein each of said first plates include fifth and sixth tubular projections and a second recess extending parallel to said first recess wherein said fifth tubular projections define a fifth tank positioned downstream from said fourth tank in fluid communication therewith and said sixth tubular projections define a sixth tank with said second recesses defining a plurality of final passageways interconnecting said fifth and sixth tanks, in fluid communication therewith;

a plurality of third plates stacked together in adjacent pairs with each of said third plates having first tubular projections of said third plate and second tubular projections of said third plate, and an elongate recessed portion wherein said third plates are in abutting engagement with one another with said first tubular projections of said third plate defining at least one upper tank and said second tubular projections of said third plate defining at least one lower tank positioned upstream from said first tank in fluid communication therewith wherein said elongate recessed portions define a plurality of fluid passageways interconnecting said upper and lower tanks in fluid communication therewith;

a first flow separator, disposed between said first and second plates, for directing the fluid to flow from said first plates to said second plates;

a second flow separator interposed between said first and third plates, for directing the fluid to flow from said third plates to said first plates; and an upstream flow separator interposed between two of said adjacent pairs of said third plates for directing the fluid to flow from said upper tank to said lower tank.

* * * * *